US005643865A

United States Patent [19]

Mermelstein et al.

[11] Patent Number: 5,643,865

[45] Date of Patent: *Jul. 1, 1997

[54] CONCENTRATED BIODEGRADABLE QUATERNARY AMMONIUM FABRIC SOFTENER COMPOSITIONS CONTAINING QUATERNARY AMMONIUM COMPOUNDS WITH SHORT FATTY ACID ALKYL CHAINS

[75] Inventors: Robert Mermelstein; Ellen Schmidt Baker; John Henry Shaw, Jr.; Errol Hoffman Wahl, all of Cincinnati, Ohio

[73] Assignee: The Procter & Gamble Company, Cincinnati, Ohio

[ * ] Notice: The term of this patent shall not extend beyond the expiration date of Pat. No. 5,460,736.

[21] Appl. No.: 467,329

[22] Filed: Jun. 6, 1995

Related U.S. Application Data

[63] Continuation of Ser. No. 245,732, May 18, 1994, abandoned.

[51] Int. Cl.[6] ..... D06M 13/46

[52] U.S. Cl. ..... 510/521; 510/522; 510/524; 510/526

[58] Field of Search ..... 252/8.6, 8.8; 510/521, 510/522, 524, 526

[56] References Cited

U.S. PATENT DOCUMENTS

| | | | |
|---|---|---|---|
| 3,915,867 | 10/1975 | Kang et al. | 252/8.8 |
| 4,137,180 | 1/1979 | Naik et al. | 252/8.8 |
| 4,456,554 | 6/1984 | Walz et al. | 260/403 |
| 4,767,547 | 8/1988 | Straathof et al. | 252/8.8 |
| 5,066,414 | 11/1991 | Chang | 252/8.8 |

FOREIGN PATENT DOCUMENTS

| | | |
|---|---|---|
| 240727A2 | 10/1987 | European Pat. Off. . |
| 284036 | 9/1988 | European Pat. Off. . |
| 336267A2 | 10/1989 | European Pat. Off. . |
| 507478A1 | 10/1992 | European Pat. Off. . |
| WO89/11522 | 11/1989 | WIPO . |

OTHER PUBLICATIONS

R. Puchta, "Cationic Surfactants in Laundry Detergents and Laundry Aftertreatment Aids," Feb. 1984, JAOCS, vol. 61, No. 2, pp. 367–376.

*Primary Examiner*—Anthony Green
*Attorney, Agent, or Firm*—Thomas G. Krivulka; Betty J. Zea

[57] ABSTRACT

The present invention relates to a stable, homogenous fabric softening composition providing good static control, selected from the group consisting of:

I. a liquid composition comprising: (A) from about 5% to about 40% by weight of a biodegradable quaternary ammonium fabric softening compound; (B) from about 0% to about 2.5% by weight of an electrolyte; (C)an aqueous liquid carrier; and (D) from about 0% to about 0.5% of a silicone antifoam agent; and II. a solid particulate composition comprising: (A) from about 50% to about 95% by weight of a biodegradable quaternary ammonium fabric softening compound; and (B) from about 0% to about 30% by weight of dispersibility modifier selected from the group consisting of: 1.) single-long-chain, $C_{10}$–$C_{22}$ alkyl, cationic surfactant; 2.) nonionic surfactant with at least 8 ethoxy moieties; 3.) amine oxide; and 4.) mixtures thereof; wherein the quaternary ammonium fabric softening compound has the formula:

$$(R)_{4-m}-N^+-[(CH_2)_n-Y-R^2]_m\ X^-$$

wherein each Y is —O—(O)C—, or —C(O)—O—; m is 2 or 3; n is 1 to 4; each R is a $C_1$–$C_6$ alkyl group, benzyl group, or mixtures thereof; each $R^2$ is a saturated $C_8$–$C_{14}$ hydrocarbyl or substituted hydrocarbyl substituent; and $X^-$ is any softener-compatible anion; wherein the composition contains less than about 1.5% by weight of fatty acid; and wherein the pH for the liquid composition is from about 2 to about 5.

23 Claims, No Drawings

CONCENTRATED BIODEGRADABLE QUATERNARY AMMONIUM FABRIC SOFTENER COMPOSITIONS CONTAINING QUATERNARY AMMONIUM COMPOUNDS WITH SHORT FATTY ACID ALKYL CHAINS

CROSS-REFERENCE TO RELATED APPLICATION

This application is a file wrapper continuation of our application Ser. No. 08/245,732, filed May 18, 1994 now abandoned.

TECHNICAL FIELD

The present invention relates to stable, homogeneous, preferably concentrated, aqueous liquid and solid particulate textile treatment compositions containing diester quaternary ammonium compounds with short fatty acid alkyl chains. In particular, it especially relates to textile softening compositions for use in the rinse cycle of a textile laundering operation to provide excellent fabric softening/static control benefits, the compositions being characterized by excellent storage and viscosity stability, as well as biodegradability.

BACKGROUND OF THE INVENTION

The art discloses many problems associated with formulating and preparing stable, concentrated, fabric conditioning formulations while providing good static and softening performance. See, for example, U.S. Pat. No. 3,904,533, Neiditch et al. issued Sep. 9, 1975. Japanese Laid Open Publication 1,249,129, filed Oct. 4, 1989, discloses a problem with dispersing fabric softener actives containing two long hydrophobic chains interrupted by ester linkages ("diester quaternary ammonium compounds") and solves it by rapid mixing. U.S. Pat. No. 5,066,414, Chang, issued Nov. 19, 1991, teaches and claims compositions containing mixtures of quaternary ammonium salts containing at least one ester linkage, nonionic surfactant such as a linear alkoxylated alcohol, and liquid carrier for improved stability and dispersibility. U.S. Pat. No. 4,767,547, Straathof et al., issued Aug. 30, 1988, claims compositions containing either diester, or monoester quaternary ammonium compounds, stabilized by maintaining a critical low pH of from 2.5 to 4.2.

U.S. Pat. No. 4,401,578, Verbruggen, issued Aug. 30, 1983 discloses hydrocarbons, fatty acids, fatty acid esters, and fatty alcohols as viscosity control agents for fabric softeners (the fabric softening compounds are disclosed as optionally comprising ester linkages in the hydrophobic chains). Diester quaternary ammonium compounds with a fatty acid, alkyl sulfate, or alkyl sulfonate anion are disclosed in European Pat. No. 336,267-A with a priority of Apr. 2, 1988. U.S. Pat. No. 4,808,321, Walley, issued Feb. 28, 1989, teaches fabric softener compositions comprising monoester analogs of ditallow dimethyl ammonium chloride which are dispersed in a liquid carrier as sub-micron particles through high shear mixing, or particles can optionally be stabilized with emulsifiers such as nonionic $C_{14-18}$ ethoxylates.

E.P. Appln. 243,735, Nusslein et al., published Nov. 4, 1987, discloses sorbitan ester plus diester quaternary ammonium compounds to improve dispersibility of concentrated dispersions. E.P. Appln. 240,727, Nusslein et. al., priority date of Mar. 12, 1986, teaches diester quaternary ammonium compounds with soaps or fatty acids for improved dispersibility in water. All of the above patents and patent applications are incorporated herein by reference.

Stability problems of concentrated liquid diester quaternary ammonium fabric softening compositions have previously been solved by the addition of various amounts of ingredients to stabilize the compositions such as nonionic ethoxylates, fatty acids, fatty alcohols, etc. Unfortunately, these additional ingredients add to the cost of the formula and increase environmental loading of the chemicals.

Furthermore, these stabilizing ingredients as well as some types of softener actives such as certain diester quaternary ammonium compounds do not always provide optimal static control for the softener compositions.

Therefore, the object of the present invention is to provide liquid or solid particulate fabric softening compositions containing diester quaternary ammonium compounds derived from shod chain fatty acyl groups, the compositions having improved static control.

Therefore, it is a further object of the present invention to provide a fabric softening compositions containing diester quaternary ammonium compounds derived from short chain fatty acyl groups with improved viscosity stability and concentratability, with minimal levels of additional ingredients such as dispersing aids, while maintaining softening performance.

SUMMARY OF THE INVENTION

The present invention provides aqueous and solid particulate, biodegradable textile softening compositions with excellent concentratability, static control, and softening performance. In addition, the aqueous compositions have excellent storage/viscosity stability. In addition, these compositions provide these benefits under worldwide laundering conditions and minimize the use of extraneous ingredients for storage/viscosity stability and static control to decrease the environmental chemical load.

In particular the compositions of the present invention relate to stable, homogeneous fabric softening compositions selected from the group consisting of:

I. a liquid composition comprising:

(A) from about 5% to about 40% by weight of a biodegradable quaternary ammonium fabric softening compound;

(B) from about 0% to about 2.5% by weight of an electrolyte;

(C) an aqueous liquid carrier; and (D) from about 0% to about 0.5% by weight of a silicone antifoam agent; and II. a solid particulate composition comprising:

(A) from about 50% to about 95% by weight of a biodegradable quaternary ammonium fabric softening compound; and (B) from about 0% to about 30% by weight of dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide; and
4. mixtures thereof;

wherein the quaternary ammonium fabric softening compound has the formula:

$$(R)_{4-m}-N^+-[(CH_2)_n-Y-R^2]_m X^-$$

wherein each Y is —O—(O)C—, or —C(O)—O—;

m is 2 or 3;

n is 1 to 4;

each R is a $C_1$–$C_6$ alkyl group, benzyl group, or mixtures thereof;

each $R^2$ is a saturated $C_8$–$C_{14}$ hydrocarbyl or substituted hydrocarbyl substituent; and $X^-$ is any softener-compatible anion;

wherein preferably the composition contains less than about 2% by weight of fatty acid; and wherein the pH of the liquid composition is from about 2 to about 5.

The benefits of concentratability include the use of less packaging material, the use of fewer organic solvents, especially volatile organic solvents, the use of fewer or no concentration aids which may add nothing to performance, etc.

All percentages and ratios used herein are by weight of the total composition. All measurements are made at 25° C., unless otherwise designated. The invention herein can comprise, consist of, consist essentially of, the essential components as well as the optional components as described herein.

DETAILED DESCRIPTION OF THE INVENTION

(A) Biodegradable Quaternary Ammonium Compound (DEQA)

The compositions of the present invention can be aqueous liquids, preferably concentrated, containing from about 5% to about 40%, preferably from about 8% to about 32%, more preferably from about 15% to about 29%, and even more preferably from about 20% to about 26% by weight of the composition, of said biodegradable, preferably diester, softening compound. The compositions can also be concentrated to particulate solid compositions containing from about 50% to about 95%, preferably from about 60% to about 90% by weight of the composition, of said biodegradable softening compound.

Water can be added to the particulate solid compositions to form dilute liquid or concentrated liquid softener compositions with a concentration of said softening compound of from about 5% to about 40%, preferably from about 8% to about 32%, more preferably from about 15% to about 30%, and even more preferably from about 20% to about 26% by weight of the composition. The particulate solid composition can also be used directly in the rinse bath to provide adequate usage concentration (e.g., from about 10 to about 1,000 ppm, preferably from about 50 to about 500 ppm, of total active ingredient). The liquid compositions can be added to the rinse to provide the same usage concentrations. Providing the composition in solid form provides cost savings on shipping the product (less weight) and cost savings on processing the composition (less shear and heat input needed to process the solid form).

The present invention relates to compositions containing a biodegradable quaternary ammonium fabric softening compound, DEQA, as an essential component, DEQA having the formula:

$$(R)_{4-m}-N^+-[(CH_2)_n-Y-R^2]_m\ X^-$$

wherein each Y is —O—(O)C—, or —C(O)—O—, preferably —O—(O)C—;

m is 2 or 3, preferably 2;

each n is 1 to 4, preferably 2;

each R substituent is a $C_1$–$C_6$ alkyl, preferably a methyl, ethyl, propyl, benzyl groups and mixtures thereof, more preferably a $C_1$–$C_3$ alkyl group;

each $R^2$ is a saturated, (the iodine value is preferably 10 or less, more preferably less than about 5), $C_8$–$C_{14}$ hydrocarbyl, or substituted hydrocarbyl substituent and the counterion, $X^-$, can be any softener-compatible anion, preferably, chloride, bromide, methylsulfate, formate, sulfate, and nitrate. Preferably $X^-$ does not include phosphate salts.

The saturated $C_8$–$C_{14}$ fatty acyl groups can be pure derivatives or can be mixed chainlengths.

Any additional expense and effort associated with the use of diester quaternary softening compounds derived from short chain fatty acyl groups is justified by the superior static control, concentratability and/or performance which was not heretofore recognized. For example, aqueous compositions containing DEQA derived from these short chain fatty acyl groups can be concentrated above about 20% without the need for additional concentration aids, especially surfactant concentration aids such as single long chain cationic surfactants, nonionic suffactants with at least about 8 ethoxy moieties, amine oxides, fatty acids, etc.

Surprisingly, the addition of fatty acid causes an increase in the viscosity of the aqueous liquid compositions. For example, fatty acid at a level of greater than about 1.5% by weight, added to concentrated aqueous dispersions, i.e. about 24% by weight of the composition of softener active, increases the viscosity of the composition of the present invention. Therefore, the solid and liquid compositions, preferably aqueous liquid compositions, of the present invention preferably have less than about 1.5% by weight of the composition of fatty acid (and/or salts of fatty acids), preferably less than about 1%, more preferably less than about 0.5% by weight of the composition.

Also, soil release polymers at a level of about 0.5% cause an increase in the viscosity of the aqueous liquid compositions. Therefore, the liquid compositions of the present invention preferably contain less than about 0.5%, more preferably less than about 0.1% by weight of the composition, of a soil release polymer.

Highly concentrated aqueous dispersions of these diester compounds can gel and/or thicken during low (40° F.) temperature storage. The concentration that will be stable in an aqueous composition will depend on the criteria for stability (e.g., stable down to about 5° C.; stable down to 0° C.; doesn't gel; gels but recovers on heating, etc.) and the other ingredients present.

It will be understood that substituents R and $R^2$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the DEQA is in the diester form, and from 0% to about 20%, preferably less than about 10%, more preferably less than about 5%, can be DEQA monoester (e.g., only one —Y—$R^2$ group).

As used herein, when the diester is specified, it will include the monoester that is normally present. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1.

Under high detergent carry-over conditions, the di/monoester ratio is preferably about 11:1. The level of monoester present can be controlled in the manufacturing of the DEQA.

DEQA compounds of the present inventions are prepared with saturated acyl groups, i.e., preferably having an Iodine Value of about 10 or less, more preferably an Iodine Value of less than about 5. These compounds and compositions have decreased odor which is associated with unsaturated DEQA.

The following are non-limiting examples (wherein all long-chain alkyl substituents are straight-chain):

Saturated $[HO—CH(CH_3)CH_2][CH_3]^+N[CH_2CH_2OC(O)C_{14}H_{29}]_2$ $Br^-$ $[C_2H_5]_2^+N[CH_2CH_2OC(O)C_{12}H_{33}]_2$ $Cl^-$ $[CH_3][C_2H_5]^+N[CH_2CH_2OC(O)C_{13}H_{27}]_2$ $I^-$ $[C_3H_7][C_2H_5]^+N[CH_2CH_2OC(O)C_{14}H_{29}]_2$ $SO_4^-CH3$ $[CH_3]_2^+N[CH_2CH_2OC(O)R^2]_2$ $Cl^-$ where $—C(O)R^2$ is derived from saturated coco fatty acid.

In addition, since the foregoing diester compounds are somewhat labile to hydrolysis, they should be handled rather carefully when used to formulate the aqueous compositions herein. For example, stable liquid compositions herein are formulated at a pH in the range of from about 2 to about 5, preferably from about 2 to about 4.5, more preferably from about 2 to about 4. The pH can be adjusted by the addition of a Bronsted acid. The pH ranges above are determined without prior dilution of the composition with water.

("Aqueous compositions" refers to the liquid compositions herein and not to the reconstituted solid particulate compositions of the present invention.)

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

(B) Electrolytes

The aqueous compositions of the present invention may comprise electrolytes at a level of from about 0% to about 2.5%, preferably from about 0.05% to about 2%, more preferably from about 1.2% to about 2% by weight of the composition. These inorganic viscosity control agents include water-soluble, ionizable salts. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the processing of the aqueous compositions herein, and later to obtain the desired viscosity. The amount of ionizable salts used depends on the amount of softener active used in the compositions and can be adjusted according to the desires of the formulator. Typical levels of salts used to control the aqueous composition viscosity are from about 0 to about 25,000 parts per million (ppm), preferably from about 12,000 to about 20,000 ppm, by weight of the composition.

(C) Liquid Carrier

The liquid carrier employed in the liquid compositions is preferably at least primarily water due to its low cost, relative availability, safety, and environmental compatibility. The level of liquid carrier is greater than about 60%, preferably greater than about 70%, more preferably from about 72% to about 80% by weight of the composition. Mixtures of water and low molecular weight, e.g., <100, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols. But preferably the composition comprises less than about 10% low molecular weight alcohols.

(D) Optional Ingredients

(1) Optional Dispersibility Modifiers for the Solid Particulate Compositions The solid particulate compositions of the present invention may require low levels of organic and/or inorganic dispersibility modifiers for adequate dispersibility after reconstitution with water.

The dispersibility modifiers are typically selected from the group consisting of (1) single long chain, $C_{10-22}$ alkyl, cationic suffactants; (2) nonionic surfactants with at least 8 ethoxy moieties; (3) amine oxides; and (4) mixtures thereof. The levels of these modifiers are described below.

The Single-Long-Chain Alkyl Cationic Surfactant

The mono-long-chain-alkyl (water-soluble) cationic surfactants, in solid compositions, are at a level of from 0.1% to about 20%, preferably from about 3% to about 15%, more preferably from about 5% to about 15% by weight of the solid particulate composition.

Such mono-long-chain-alkyl cationic surfactants useful in the present invention are, preferably, quaternary ammonium salts of the general formula:

$$[R^2N^+R_3]X^-$$

wherein the $R^2$ group is $C_{10}$–$C_{22}$ hydrocarbon group, preferably $C_{12}$–$C_{16}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkylene group having from about 10 to about 22 carbon atoms, preferably from about 12 to about 16 carbon atoms for solid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

It will be understood that the main function of the water-soluble cationic surfactant is to increase the dispersibility of the solid particulate diester softener and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{10}$–$C_{22}$ alkyl chain can also be used.

Some alkyl imidazolinium salts useful in the present invention have the general formula:

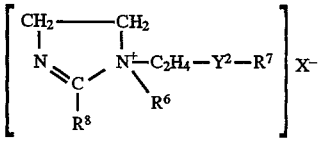

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

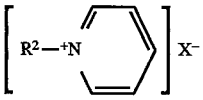

wherein $R^2$ and $X^-$ are as defined above. A typical material of this type is cetyl pyridinium chloride.

Nonionic Surfactant (Alkoxylated Materials)

Suitable nonionic surfactants to serve as the dispersibility modifier for solid particulate compositions include addition products of ethylene oxide and, optionally, propylene oxide, with fatty alcohols, fatty acids, fatty amines, etc.

Any of the alkoxylated materials of the particular type described hereinafter can be used as the nonionic surfactant. In general terms, the nonionics herein, when used alone in solid compositions are at a level of from about 5% to about 20%, preferably from about 8% to about 15%. Suitable compounds are substantially water-soluble surfactants of the general formula:

$$R^2\text{–}Y\text{–}(C_2H_4O)_z\text{—}C_2H_4OH$$

wherein $R^2$ for solid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for solid compositions is from about 10 to about 14 carbon atoms. In the general formula for the ethoxylated nonionic suffactants herein, Y is typically —O—, —C(O)O—, —C(O)N(R)—, or —C(O)N(R)R—, in which $R^2$, and R, when present, have the meanings given hereinbefore, and/or R can be hydrogen, and z is at least about 8, preferably at least about 10–11.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxyl (EO) groups in the molecule.

a. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful dispersibility modifiers in the context of this invention. Exemplary ethoxylated primary alcohols useful herein as the dispersibility modifiers of the compositions are n—$C_{18}$EO(10); and n—$C_{10}$EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO(25).

b. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful dispersibility modifiers in the context of this invention. Exemplary ethoxylated secondary alcohols useful herein as the dispersibility modifiers of the compositions are: 2—$C_{16}$EO(11); 2—$C_{20}$EO(11); and 2—$C_{16}$EO(14).

c. Alkyl Phenol Alkoxylates

As in the case of the alcohol alkoxylates, the hexa- through octadecaethoxylates of alkylated phenols, particularly monohydric alkylphenols, having an HLB within the range recited herein are useful as the dispersibility modifiers of the instant compositions. The hexa- through octadeca-ethoxylates of p-tridecylphenol, mopentadecylphenol, and the like, are useful herein. Exemplary ethoxylated alkylphenols useful as the dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

d. Olefinic Alkoxylates

The alkenyl alcohols, both primary and secondary, and alkenyl phenols corresponding to those disclosed immediately hereinabove can be ethoxylated to an HLB within the range recited herein and used as the dispersibility modifiers of the instant compositions.

e. Branched Chain Alkoxylates

Branched chain primary and secondary alcohols which are available from the well-known "OXO" process can be ethoxylated and employed as the dispersibility modifiers of compositions herein.

The above ethoxylated nonionic surfactants are useful in the present compositions alone or in combination, and the term "nonionic surfactant" encompasses mixed nonionic surface active agents.

Amine Oxides

Suitable amine oxides include those with one alkyl or hydroxyalkyl moiety of about 8 to about 28 carbon atoms, preferably from about 8 to about 16 carbon atoms, and two alkyl moieties selected from the group consisting of alkyl groups and hydroxyalkyl groups with about 1 to about 3 carbon atoms.

The amine oxides in solid compositions are at a level of from 0% to about 5%, preferably from about 3% to about 15%.

Examples include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

2. Optional Silicone Antifoam Agents

The compositions of the present invention optionally comprise from about 0% to about 0.5%, preferably from about 0.01% to about 0.4%, more preferably from about 0.05% to about 0.2% by weight of the composition, of a silicone antifoam agent.

The antifoam component of the present invention comprises a silicone suds controlling agent. The silicone materials employed as the suds controlling agents herein can be alkylated polysiloxane materials of several types, either singly or in combination with various solid materials such as silica aerogels and xerogels and hydrophobic silicas of various types. In industrial practice, the term "silicone" has become a generic term which encompasses a variety of relatively high molecular weight polymers containing siloxane units and hydrocarbyl groups of various types. In general terms, the silicone suds controllers can be described as siloxanes having the general structural backbone:

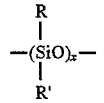

wherein x is from about 20 to about 2,000, and R and R' are each alkyl or aryl groups, especially methyl, ethyl, propyl, butyl or phenyl. The polydimethylsiloxanes (R and R' are methyl) having a molecular weight within the range of from about 200 to about 200,000, and higher, are all useful as suds controlling agents. Silicone materials are commercially available from the Dew Corning Corporation under the trade name Silicone 200 Fluids®. Preferred silicone suds control agents of the present invention include antifoam emulsions available under the tradename DC-2210 from Dew Corning. Suitable polydimethylsiloxanes have a viscosity of from about 20 cs to about 60,000 cs, preferably from about 20–1500 cs, at 250° C. when used with silica and/or siloxane resin.

Other preferred antifoam materials are described in U.S. Pat. No. 4,652,392, Baginski et al., issued on Mar. 24, 1987, which is herein incorporated by reference in its entirety.

Typical levels of silicone antifoam agent used to control the composition foaming are from about 0 to about 5,000 parts per million (ppm), preferably from about 100 to about 200 ppm, by weight of the composition.

3. Optional Bacteriocides

Examples of bacteriocides that can be used in the compositions of this invention are parabens, especially methyl, glutaraldehyde, formaldehyde, 2-bromo-2-nitropropane-1, 3-diol sold by Inolex Chemicals under the trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bacteriocides used in the present compositions are from about 1 to about 2,000 ppm by weight of the composition, depending on the type of bacteriocide selected. Methyl paraben is especially effective for mold growth in aqueous fabric softening compositions with under 10% by weight of the diester compound.

4. Optional Enzymes (Cellulose)

The cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of Humicola insolens (Humicola grisea var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium. Preferred cellulases for use herein are characterized in that they provide at least 10% removal of immobilized radioactive labeled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43kD cellulase derived from Humicola insolens, DSM 1800, or which is homologous to said 43kD endoglucanase.

The cellulases herein should be used in the fabric-conditioning compositions of the present invention at a level equivalent to an activity from about 5 to about 125 CEVU/gram of composition [CEVU=Cellulase (equivalent) Viscosity Unit, as described, for example, in WO 91/13136, incorporated herein by reference in its entirety], and most preferably about 20 to about 100. Such levels of cellulase are selected to provide the herein preferred cellulase activity at a level such that the compositions deliver a fabric softening effective amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 5 CEVU's per liter rinse solution to about 50 CEVU's per liter rinse solution, more preferably from about 5 CEVU's per liter to about 30 CEVU's per liter, even more preferably from about 10 CEVU's per liter to about 25 CEVU's per liter, and most preferably from about 10 CEVU's per liter to about 20 CEVU's per liter.

5. Other Optional Ingredients

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-corrosion agents, anti-pilling agents and the like.

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactants. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to DEQA is from about 1:6 to about 1:2, preferably from about 1:4 to about 1:2. The level of optional nonionic softener in the liquid composition is typically from about 0.5% to about 10%, preferably from about 1% to about 5%.

Preferred nonionic softeners are disclosed in U.S. Pat. No. 5,185,088, Hartman et al., issued Feb. 9, 1993, which is herein incorporated by reference in its entirety.

Process for the Preparation of Liquid Concentrated, Biodegradable, Fabric Softener Compositions The present invention also includes a process for preparing concentrated aqueous biodegradable quaternary ammonium fabric softener compositions. Preferably, the process of the present invention comprises adding the electrolyte in two steps. Some of the electrolyte is added, preferably one-half of the electrolyte, at a temperature where the molten organic premix of the fabric softener active is liquified and the remainder of the electrolyte is added to the composition at room temperature. Specifically, a molten organic premix of the fabric softener active and any other organic materials is added into an acidic water seat at about 175° F.(80° C.). The organic premix typically comprises of the biodegradable fabric softener active and, preferably, at least an effective amount of low molecular weight alcohol processing aid, e.g., ethanol or isopropanol, preferably ethanol. Electrolyte, as described hereinbefore, is then added to the mixture at a range of from about 0 ppm to about 12,500 ppm, more preferably from about 250 ppm to about 10,000 ppm, more preferably from about 6,000 ppm to about 10,000 ppm, at a temperature where the molten organic premix of the fabric softener active remains liquified. High shear milling of the aqueous dispersion can be conducted either during the addition of the molten premix into the acid water seat, or during the electrolyte addition, or after electrolyte addition. Perfume, if present is added next. The dispersion is then cooled to ambient temperature and the remaining electrolyte is added.

The above described preferred process provides a convenient method for preparing concentrated aqueous biodegradable fabric softener dispersions, as recited herein, wherein the biodegradable fabric softening composition consists of greater than about 15% by weight, preferably from about 20% to about 26% by weight of total biodegradable fabric softener active.

In the method aspect of this invention, fabrics or fibers are contacted with an effective amount, generally from about 10 ml to about 150 ml (per 3.5 kg of fiber or fabric being treated) of the softener actives (including diester compound) herein in an aqueous bath. Of course, the amount used is based upon the judgment of the user, depending on concentration of the composition, fiber or fabric type, degree of softness desired, and the like. Preferably, the rinse bath contains from about 10 to about 1,000 ppm, preferably from about 50 to about 500 ppm, of the DEQA fabric softening compounds herein.

The following examples further describe and demonstrate embodiments within the scope of the present invention. The examples are given solely for the purpose of illustration and are not to be construed as limitations of the present invention, as many variations thereof are possible without departing from the spirit and scope of the invention.

EXAMPLES I and II

| Component | I Wt. % | II Wt. % |
|---|---|---|
| Diester Compound[1] | 24.0 | 24.0 |
| Ethanol | 4.2 | 2.7 |
| Coco Fatty Acid | — | 0.25 |
| DC-2210[2](10%) | 0.1 | 0.3 |
| $CaCl_2$(solids basis) | 1.7 | 1.5 |
| HCl | 0.02 | 0.02 |
| DI Water | Balance | Balance |
| pH = 2.8–3.5 | | |

[1]Di(cocooyloxyethyl)dimethyl ammonium chloride.
[2]Antifoam available from Dow Corning.

The above compositions are made by the following batch process for a 300 g batch:

1. Separately, heat the premix containing the diester compound, ethanol, and optionally fatty acid, and the water seat containing antifoam agent and HCl to about 175° F.(80° C.)(130° F. to 190° F.);

2. Slowly add the molten diester compound premix into the water seat over 2 minutes under rapid agitation by an IKA turbine blade mixer (2,000 rpm) resulting in a highly viscous dispersion.

3. Add to the dispersion about 8,000 ppm of $CaCl_2$ as a 15% aqueous solution over about 3 minutes.

4. Cool the dispersion to room temperature in an ice bath for about 9 minutes.

5. Add 9,000 ppm $CaCl_2$ over 3–4 minutes to the cooled dispersion. The composition is stable and very fluid having an initial viscosity of from about 20 cps to about 40 cps.

EXAMPLES III–IX

Solid Particulate Compositions Plus Water to Form Liquid Compositions

| Component | III Wt. % | IV Wt. % |
|---|---|---|
| Diester Compound[1] | 8.1 | 6.00 |
| Ethoxylated Fatty Alcohol[2] | 0.5 | — |
| PGMS[3] | — | 1.74 |
| Coconut Choline Ester Chloride | — | 0.86 |
| Minors (Perfume; Antifoam) | 0.35 | 0.35 |

[1]Di(cocooyloxyethyl)dimethyl ammonium chloride.
[2]$C_{16}$–$C_{18}E_{18}$.
[3]Polyglycerol monostearate having a trade name of Radiasurf 7248.

| Component | V Wt. % | VI Wt. % |
|---|---|---|
| Diester Compound[1] | 7.6 | 7.6 |
| Ethoxylated Fatty Alcohol[2] | 1 | 1 |

[1]Di(cocooyloxyethyl)dimethyl ammonium chloride.
[2]V is $C_{16}$–$C_{18}E_{11}$. VI is $C_{16-18}E_{50}$.

| Component | VII Wt. % | VIII Wt. % | IX Wt. % |
|---|---|---|---|
| Diester Compound[1] | 7.6 | 8.1 | 23.5 |
| Ethoxylated Fatty Alcohol[2] | 1 | — | — |
| Coconut Choline Ester Chloride | — | 0.5 | 2.5 |
| Minors (Perfume; Antifoam) | — | 0.35 | 1.5 |
| Electrolyte | — | — | 0.4 |

[1]Di(cocooyloxyethyl)dimethyl ammonium chloride.
[2]$C_{10}E_{11}$.
[3]Polyglycerol monostearate having a trade name of Radiasurf 7248.

The above liquid compositions are made from the corresponding solid compositions having the same active material, on a 100% active weight basis, by the procedure given below. This shows the surprising ability of the solid particulate compositions herein to effectively disperse following simple addition to lukewarm water with gentle agitation (e.g., manual shaking). Improved results are obtained by using higher temperatures and/or effective mixing conditions, e.g., high shear mixing, milling, etc. However, even the mild conditions provide acceptable aqueous compositions.

Procedure

Molten diester is mixed with molten ethoxylated fatty alcohol or molten coconut choline ester chloride. In No. IV, molten PGMS is also added. The mixture is cooled and solidified by pouring onto a metal plate, and then ground. The solvent is removed by a Rotovapor® (2 hrs. at 40°–50° C. at maximum vacuum). The resulting powder is ground and sieved. The reconstitution of the powder is standardized as follows:

The total active solid is 8.6% (diester plus ethoxylated fatty alcohol). Tap water is heated to 35° C. (95° F). Antifoam is added to the water. The active powder is mixed with the perfume powder. This mix is sprinkled on the water under continuous agitation (up to 2,000 rpm for 10 minutes). This product is cooled by means of a cooling spiral prior to storage. The fresh product is transferred to a bottle and left standing to cool.

What is claimed is:

1. A stable, homogenous liquid composition having fabric softening and static controlling benefits comprising (A) from about 5% to about 40% by weight of a biodegradable quaternary ammonium fabric softening compound;

(B) from about 0% to about 2.5% by weight of an electrolyte;

(C) an aqueous liquid carrier; and (D) from about 0% to about 0.5% of a silicone antifoam agent, wherein the quaternary ammonium fabric softening compound has the formula:

$$(R)_{4-m}-N^+-[(CH_2)_n-Y-R^2]_m X^-$$

wherein each Y is —O—(O)C—, or —C(O)—O—;

m is 2 or 3;

n is 1 to 4;

each R is a $C_1$–$C_6$ alkyl group, benzyl group, or mixtures thereof;

each $R^2$ is a saturated $C_8$–$C_{14}$ hydrocarbyl or substituted hydrocarbyl substituent; and $X^-$ is any softener compatible anion;

wherein the composition contains less than about 1.5% by weight of fatty acid; and wherein the liquid composition has a pH from about 2 to about 5.

2. The liquid composition of claim 1 wherein the level of fatty acid is less than about 1% by weight of the composition.

3. The liquid composition of claim 2 wherein the level of fatty acid is less than about 0.5% by weight of the composition.

4. The liquid composition of claim 1 wherein the biodegradable quaternary ammonium fabric softening compound is at a level of from about 8% to about 32% by weight of the composition.

5. The liquid composition of claim 4 wherein each Y is —O—(O)C—; m is 2; n is 2; and each R is a $C_1$–$C_3$ alkyl group.

6. The liquid composition of claim 5 wherein $R^2$ is a hydrocarbon chain having at least about 90% $C_{12}$–$C_{14}$ chainlength.

7. The liquid composition of claim 6 wherein the level of electrolyte is from about 0.05% to about 2% by weight and the level of silicone antifoam agent is from about 0.01% to about 0.4% by weight of the composition.

8. The liquid composition of claim 1 wherein the biodegradable quaternary ammonium fabric softening compound is at a level of from about 20% to about 26% by weight of the composition.

9. The liquid composition of claim 8 wherein each Y is —O—(O)C—; m is 2; n is 2; and each R is a $C_1$–$C_3$ alkyl group.

10. The liquid composition of claim 9 wherein $R^2$ is a hydrocarbon chain having at least about 90% $C_{12}$–$C_{14}$ chainlength.

11. The liquid composition of claim 10 wherein the level of electrolyte is from about 1.2% to about 2% by weight and the level of silicone antifoam agent is from about 0.05% to about 0.2% by weight of the composition.

12. In a textile laundering operation comprising a rinse cycle, the method of controlling static and softening fabrics wherein the improvement comprises adding an amount, effective to control static and soften fabrics, of the composition of claim 1 to said rinse cycle of said textile laundering operation.

13. A process of making the liquid composition of claim 1 comprising the steps of:

(A) adding from about ¼ to about ¾ of the total electrolyte at a temperature where an organic premix comprising:

(1) the biodegradable quaternary ammonium fabric softening compound; and (2) less than about 10% of an alcohol having a molecular weight of less than 100; is liquified;

(B) cooling the composition to ambient temperature; and (C) adding from about ¼ to about ¾ of the total electrolyte;

wherein the biodegradable quaternary ammonium fabric softening compound is at a level of from about 15% to about 40% by weight of the composition; and wherein the total electrolyte in the composition is from about 250 ppm to about 25,000 ppm.

14. The process of claim 13 wherein ½ of the total electrolyte is added at a temperature where the organic premix is liquified and ½ of the total electrolyte is added after cooling the composition to ambient temperature.

15. A stable, homogenous fabric softening and static controlling solid particulate composition comprising:

(A) from about 50% to about 95% by weight of a biodegradable quaternary ammonium fabric softening compound; and (B) from about 0% to about 30% by weight of dispersibility modifier selected from the group consisting of:

1. single-long-chain, $C_{10}$–$C_{22}$ alkyl, cationic surfactant;

2. nonionic surfactant with at least 8 ethoxy moieties;

3. amine oxide; and 4. mixtures thereof;

wherein the quaternary ammonium fabric softening compound has the formula:

$$(R)_{4-m}\text{-}N^+\text{-}[(CH_2)_n\text{—}Y\text{—}R^2]_m X^-$$

wherein each Y is —O—(O)C—, or —C(O)—O—;

m is 2 or 3;

n is 1 to 4;

each R is a $C_1$–$C_6$ alkyl group, benzyl group, or mixtures thereof;

each $R^2$ is a saturated $C_8$–$C_{14}$ hydrocarbyl or substituted hydrocarbyl substituent; and $X^-$ is any softener-compatible anion;

wherein the composition contains less than about 1.5% by weight of fatty acid.

16. The solid particulate composition of claim 15 comprising:

(A) from about 60% to about 90% by weight of biodegradable quaternary ammonium fabric softening compound; and (B) from about 0.1% to about 20% by weight of dispersibility modifier.

17. The solid particulate composition of claim 16 wherein each Y is —O—(O)C—; m is 2; n is 2; and each R is a $C_1$–$C_3$ alkyl group.

18. The solid particulate composition of claim 17 wherein $R^2$ is a hydrocarbon chain having at least about 90% $C_{12}$–$C_{14}$ chainlength.

19. The solid particulate composition of claim 16 wherein (B) is a single-long-chain, $C_{10}$–$C_{22}$ alkyl, cationic surfactant at a level of from about 3% to about 15% by weight of the composition.

20. The solid particulate composition of claim 19 wherein (B) is $C_{12}$–$C_{14}$ choline ester.

21. The solid particulate composition of claim 16 wherein (B) is a nonionic surfactant at a level of from about 5% to about 20% by weight of the composition.

22. The solid particulate composition of claim 21 wherein (B) is $C_{10}$–$C_{14}$ alcohol with poly(10–18) ethoxylate.

23. In a textile laundering operation comprising a rinse cycle, the method of controlling static and softening fabrics wherein the improvement comprises adding an amount, effective to control static and soften fabrics, of the composition of claim 15 to said rinse cycle of said textile laundering operation.

* * * * *